United States Patent [19]

Suto

[11] Patent Number: 4,992,071

[45] Date of Patent: Feb. 12, 1991

[54] COOLING DEVICE FOR A DRIVING MOTOR IN A TRAVELING TOY

[75] Inventor: Shohei Suto, Tokyo, Japan

[73] Assignee: Taiyo Kogyo Company, Ltd., Tokyo, Japan

[21] Appl. No.: 273,512

[22] PCT Filed: Feb. 18, 1988

[86] PCT No.: PCT/JP88/00163

§ 371 Date: Oct. 18, 1988

§ 102(e) Date: Oct. 18, 1988

[87] PCT Pub. No.: WO88/06053

PCT Pub. Date: Aug. 25, 1988

[30] Foreign Application Priority Data

Feb. 18, 1987 [JP] Japan ..... 62-21346

[51] Int. Cl.[5] ..... A63H 29/00; A63H 30/04; A63H 33/00; H02K 1/32

[52] U.S. Cl. ..... 446/457; 446/456; 446/484; 310/61

[58] Field of Search ..... 446/457, 460, 462, 463, 446/484, 454, 455, 57, 456, 90; 180/68.1; 165/182; 310/61

[56] References Cited

U.S. PATENT DOCUMENTS

| | | | |
|---|---|---|---|
| 2,171,091 | 8/1939 | Klavik | 180/68.1 |
| 2,194,396 | 3/1940 | Klavik | 180/68.1 |
| 2,585,220 | 2/1952 | Brezek | 180/68.1 |
| 2,731,098 | 1/1956 | Saives | 180/68.1 |
| 3,738,058 | 6/1973 | Mabuchi | 446/57 |
| 3,791,471 | 2/1974 | Buser | 180/68.1 |
| 3,914,899 | 10/1975 | Mabuchi | 446/57 |
| 4,137,472 | 1/1979 | Workman | 310/61 |
| 4,143,710 | 3/1979 | LaPorte et al. | 165/182 |
| 4,171,592 | 10/1979 | Saitoh | 446/456 |
| 4,638,854 | 1/1987 | Noren | 165/182 X |

FOREIGN PATENT DOCUMENTS

| | | | |
|---|---|---|---|
| P12167 | 11/1956 | Fed. Rep. of Germany | 446/491 |
| 8806053 | 8/1988 | PCT Int'l Appl. | 446/457 |

*Primary Examiner*—Robert A. Hafer
*Assistant Examiner*—D. Neal Muir
*Attorney, Agent, or Firm*—Oblon, Spivak, McClelland, Maier & Neustadt

[57] ABSTRACT

A cooling device for a driving motor in a traveling toy operated by, for example, wireless includes a ventilating conduit having an air intake port which opens to the windward of a current of air produced around the toy in traveling, and radiating plate having its basal portion attached to the aforementioned driving motor, so as to allow the air introduced into the ventilating conduit to be blown against the driving motor and the radiating plate. Since this device is simple in structure and serves to effectively cool the driving motor by introducing the current of air produced when the toy travels into the body of the toy, this device is suitable for cooling the driving motor in the traveling toy.

6 Claims, 3 Drawing Sheets

COOLING DEVICE FOR A DRIVING MOTOR IN A TRAVELING TOY

RELEVANT TECHNICAL FIELD

This invention relates to a cooling device a driving motor in a traveling toy which is controlled by wireless for example, and more particularly to a cooling device for efficiently cooling a driving motor in a toy which produces heat while traveling.

BACKGROUND OF THE STATE OF THE ART

Conventionally, there has been a cooling means for a driving motor in a conventional traveling toy, which cooling device is constructed by forming an opening in a side wall of the driving motor. No specific device has been proposed for cooling the driving motor.

However, in a case where the traveling toy operated by wireless is driven to travel at high speed or on a rough road, a large load is applied on the driving motor, consequently to produce heat. The heat produced during traveling may cause breakage in the driving motor or deformation of a guide member of the motor. Thus, the conventional driving motor has suffered a disadvantage that it will be prevented from being operated at normal due to the production of heat.

DESCRIPTION OF THE INVENTION

The present invention is the fruit of the enthusiastic study made by the inventor of this invention to eliminate the drawbacks mentioned above and aimed at providing a cooling device for a driving motor in a traveling toy, which comprises a ventilating conduit having an air intake port which opens to the windward of a current of air flowing around the traveling toy in traveling and a radiating plate having its basal portion connected to the aforesaid driving motor, whereby the air is blown against the driving motor and radiating plate through the aforesaid ventilating conduit.

That is to say, according to this invention, the current of air generated around the toy in traveling is introduced inside the ventilating conduit through the air intake port and blown directly against the driving motor and the radiating plate which is attached at its basal portion to the peripheral portion of the driving motor, thereby to cool the driving motor.

Furthermore, the more speedily the traveling toy moves, the larger the heat release value becomes, while the quantity of the air flowing into the ventilating conduit is also increased with gaining the speed of the traveling toy in traveling. This is because the air intake port of the ventilating conduit open to the windward of the current of air produced around the toy in traveling. Namely, the efficiency of cooling the driving motor is improved with increasing the speed of the toy in traveling, thereby to effectively suppress the rise of temperature of the driving motor which produces heat.

PREFERRED MODES FOR EXECUTING THE INVENTION

Figure 1:
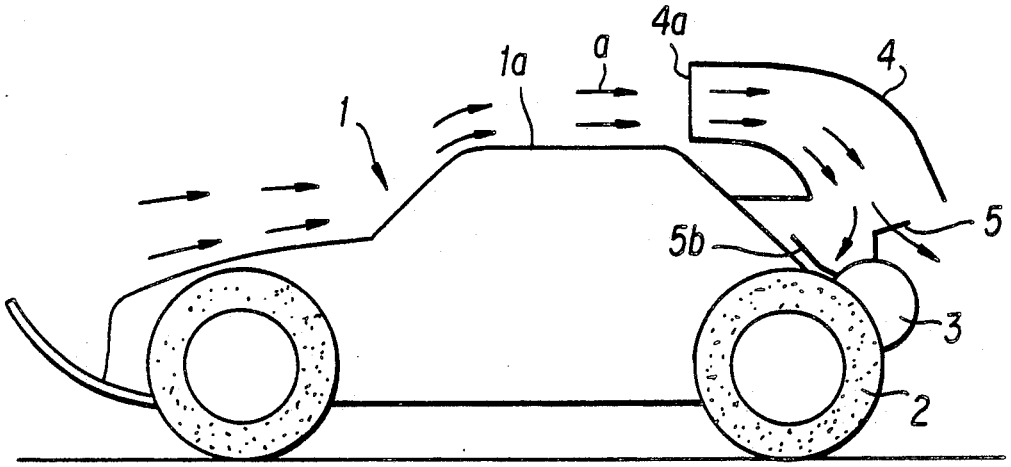
FIG. 1 is a side elevation showing one embodiment invention.

The present invention will be explained in detail hereinafter with reference to the accompanying drawings.

Reference numeral 1 denotes a body of a traveling toy such as a model car operated by wireless. The body 1 is provided on its rear portion with a driving motor 3 for rotating rear wheels 2.

The aforesaid driving motor 3 in this embodiment is provided on its upper side with a ventilating conduit 4 having an air intake port 4*a* open to the windward of a current of air which is produced around the body while the toy travels. The air intake port 4*a* in this embodiment is located above the rear portion of a roof 1*a* of the body 1.

On the other hand, beneath an air outlet port of the ventilating conduit 4, there is disposed a radiating plate 5 so as to hinder the current of air flowing out from the ventilating conduit 4. The radiating plate 5 has a plurality of air holes 5*a* and is attached to the driving motor 4 in such a state that the basal portion 5*b* of the radiating plate is in contact with the peripheral portion of the driving motor.

With the structure noted above, a current of air in conformity with the outer configuration of the body is produced when the body 1 is operated to run by wireless or other methods. Namely, the current of air a is produced along the, roof 1*a* of the body 1. The current of air a is introduced into the ventilating conduit 4 through the air intake port 4*a* located above the rear portion of the roof 1*a* of the body 1 and blown directly against the driving motor 3 through the air holes 5*a* formed in the radiating plate 5 and against the upper surface of the radiating plate 5 having the basal portion connected to the peripheral portion of the driving motor 3. Thus, the air blown directly against the driving motor 3 serves to cool directly the driving motor 3. The air blown against the upper surface of the radiating plate 5 serves to cool the driving motor 3 by means of the basal portion 5*b* of the radiator plate 5 which is in contact with the peripheral of the driving motor 5.

Figure 3:
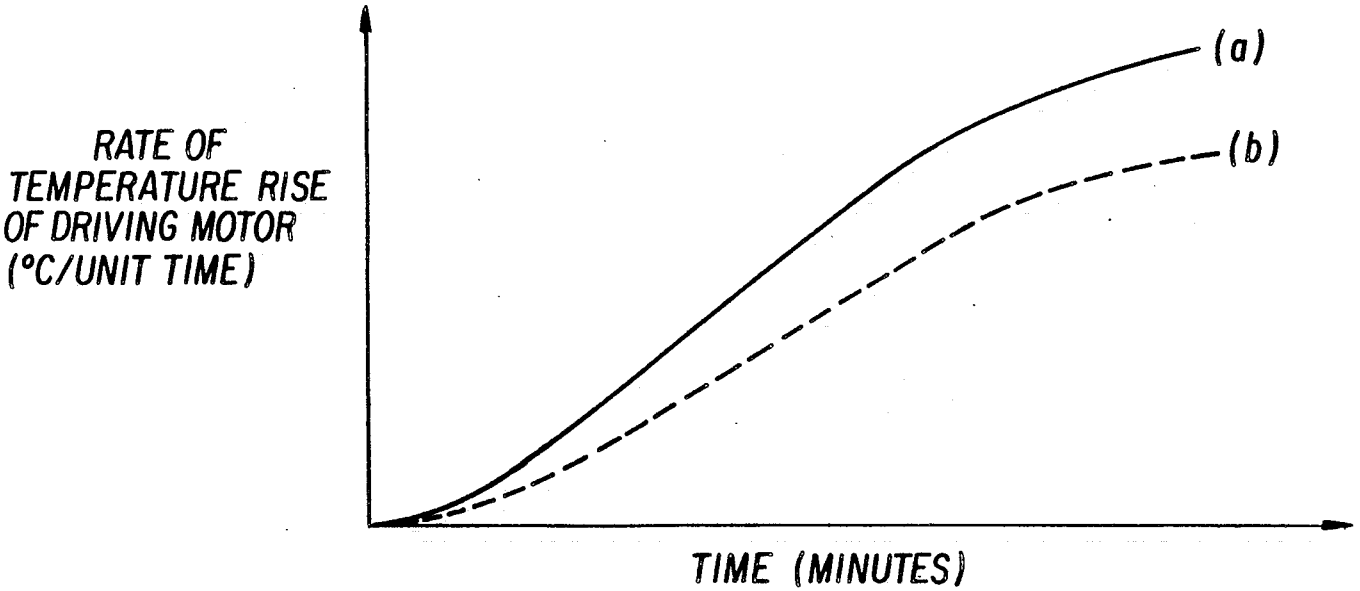
FIG. 3 is a diagram showing the rate of temperature rise of a driving motor relative to the travel time of a traveling toy.

The heat release value of the driving motor 3 is increased with gaining the speed of the body 1 in traveling. Nevertheless, the more speedily the body travels, the larger the quantity of air introduced into the ventilating conduit 4 becomes, because the air intake port 4*a* of the ventilating conduit 4 is open to the windward of the current of air produced around the body in traveling. Accordingly, the effect of cooling the driving motor 3 is heightened with gaining the speed of the body 1 in traveling, thereby to suppress the rise in temperature of the driving motor 3 which produces heat when being driven. As is understood from the test results shown in FIG. 3 in which the rate of temperature rise of the driving motor is shown, the rate of temperature rise of the driving motor is markedly suppressed; namely, compared with the curve (a) of temperature rise of the driving motor when the body travels without using a ventilating conduit as noted above, and the curve (b) of temperature rise of the driving motor when the body adpting the ventilating conduit travels at the same speed while introducing a current of air into ventilating conduit at 3m/s shows a lower rate.

The ventilating conduit 4 is only required to have a function of bringing the air introduced inside the ventilating conduit into touch with the radiating plate 5, and therefore, it is not necessarily formed in the shape of a cylinder. Also, the air intake port 4*a* of the ventilating conduit 4 is not necessarily located above the rear portion of the roof 1*a* of the body 1 as shown in FIG. 1.

Figure 4:
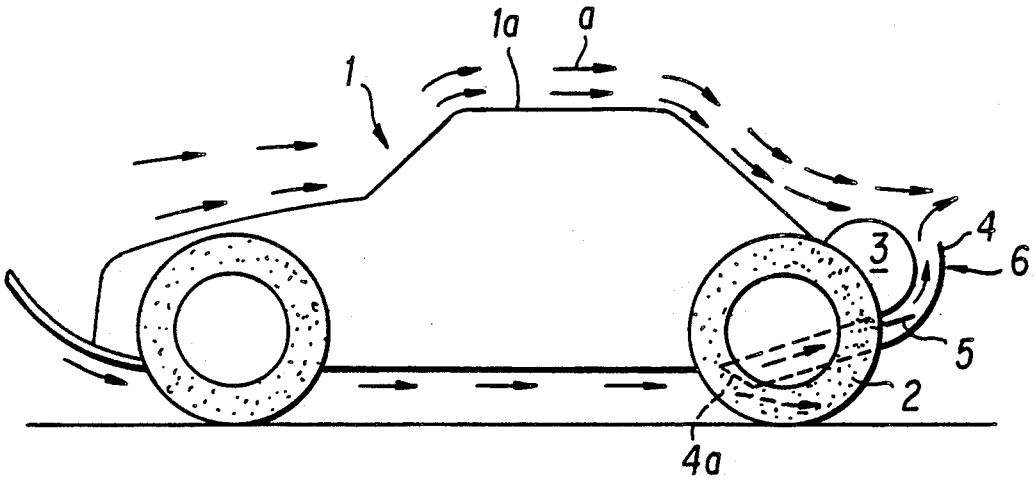
FIG. 4 is a side elevation showing another embodiment of this invention.
Figure 2:
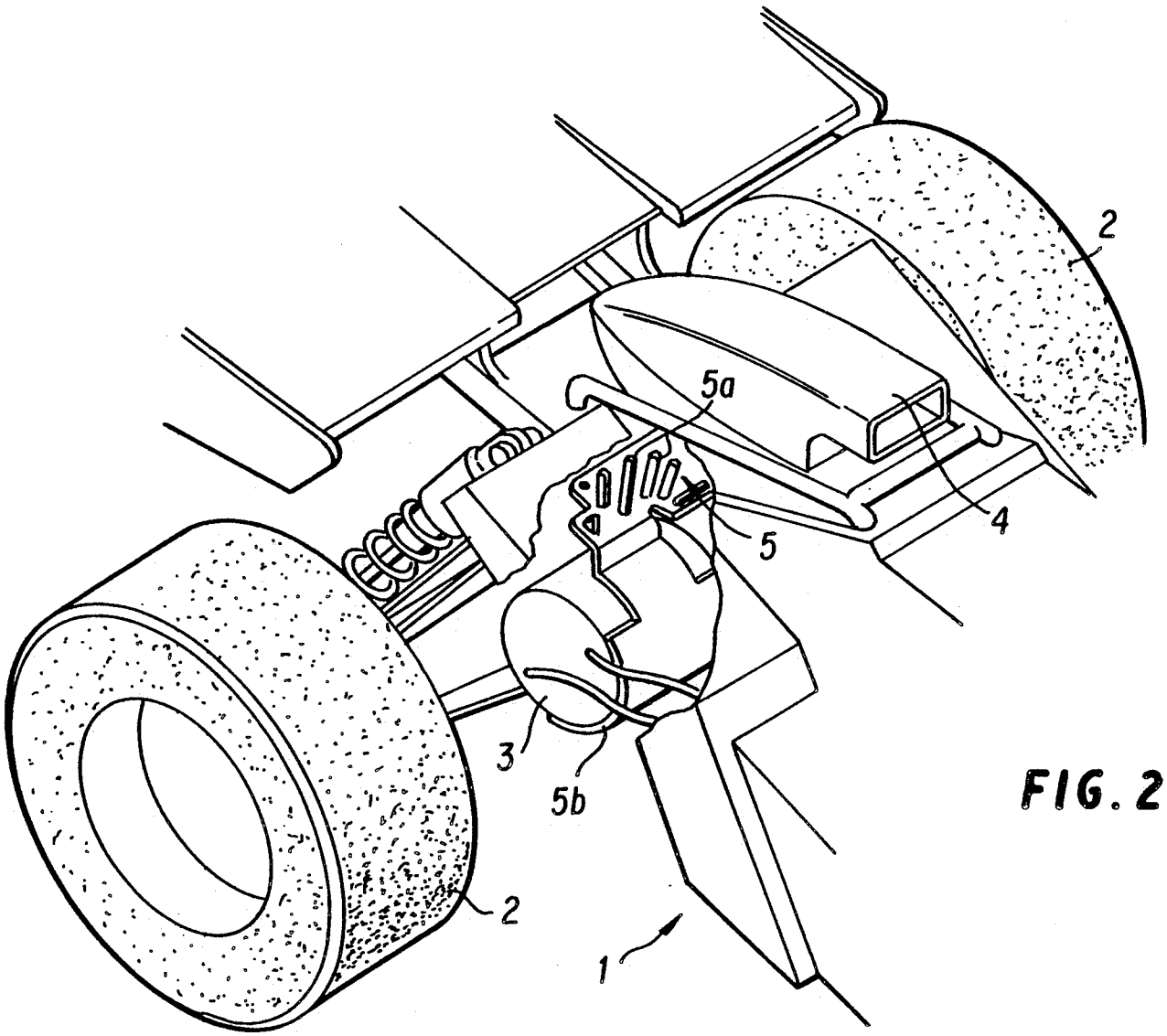
FIG. 2 is a partially sectioned, enlarged perspective view of the same.

For instance, in another embodiment illustrated in FIG. 4, there is disposed a guide plate 6 for enclosing the lower half part of the driving motor 3 so as to form the ventilating conduit 4 between the aforesaid guide plate 6 and the driving motor 3. In this embodiment, the radiating plate 5 is attached to the lower portion of the driving motor 3.

INDUSTRIAL APPLICABILITY

As is apparent from the above, according to the present invention, a current of air produced around the body in traveling can be effectively introduced inside the body to cool the driving motor, thereby to suppress efficiently the temperature rise of the driving motor in operation. Thus, decrease in driving performance (torque), which is caused by heat produced by the driving motor in operation, can be prevented. In conclusion, the present invention provides a suitable cooling device for the driving motor in traveling toys controlled by wireless.

I claim:

1. A cooling device for a driving motor mounted in a model car, comprising:

a ventilating conduit having an air intake port;

a radiating plate having a plurality of air holes;

said conduit being mounted on said car with said intake port open windward of a current of air formed by the motion of said card, and said conduit directing said current of air onto said plate and said motor to cool said plate and said motor, said current of air being directed in a direction substantially perpendicular to a plane defined by said plate;

said plate having a basal portion attached to said motor and a radiating portion positioned in said current of air, said holes allowing passage of said current of air through said plate and onto said motor.

2. A model car as recited in claim 1, wherein said basal portion of said plate is attached to the periphery of said motor, extends partially around said motor, and conforms to the shape of said motor.

3. A model car as recited in claim 1, wherein said conduit is mounted on the rear portion of said car.

4. A model car as recited in claim 1, wherein said intake portion of said conduit is located above the uppermost point of the portion of said car that is forward of said intake port.

5. A cooling device according to claim 1 wherein a guide plate is provided outside the driving motor so as to form the ventilating conduit between the driving motor and the guide plate.

6. A cooling device for driving motor mounted in a model car, comprising:

a ventilating conduit having an air intake port;

a radiating plate having a plurality of air holes;

said conduit being mounted on the rear portion of said car with said intake port open windward of a current of air formed by the motion of said car, said intake port being located above the uppermost point of the portion of said car that is forward of said intake port, and said conduit directing said current of air onto said plate and said motor to cool said plate and said motor, said current of air being directed in a direction substantially perpendicular to a plane defined by said plate;

said plate having a basal portion attached to said motor, extending partially around said motor, and conforming to the shape of said motor, and said plate having radiating portion positioned in said current of air, said holes allowing passage of said current of air through said plate and onto said motor.

* * * * *

UNITED STATES PATENT AND TRADEMARK OFFICE

CERTIFICATE OF CORRECTION

PATENT NO. : 4,992,071

DATED : February 12, 1991

INVENTOR(S) : Shohei Suto

It is certified that error appears in the above-identified patent and that said Letters Patent is hereby corrected as shown below:

On the title page:

In the Foreign Application Priority Data, the Priority information is incorrect, should be, --Feb. 18, 1987 [JP] Japan .....62-21364--.

Signed and Sealed this

Twenty-seventh Day of October, 1992

*Attest:*

DOUGLAS B. COMER

*Attesting Officer*

*Acting Commissioner of Patents and Trademarks*